United States Patent [19]

Griesen et al.

[11] 4,281,231

[45] Jul. 28, 1981

[54] HIGH TENSION VACUUM SWITCHES

[75] Inventors: Bertus Griesen; Harry C. W. Gundlach, both of Hengelo, Netherlands

[73] Assignee: Hazemeijer B.V., Hengelo, Netherlands

[21] Appl. No.: 960,938

[22] Filed: Nov. 15, 1978

[30] Foreign Application Priority Data

Nov. 23, 1977 [NL] Netherlands ..... 7712932

[51] Int. Cl.[3] ..... H01H 33/66

[52] U.S. Cl. ..... 200/144 B; 200/146 R

[58] Field of Search ..... 200/144 B, 146 R

[56] References Cited

U.S. PATENT DOCUMENTS

| | | | |
|---|---|---|---|
| 3,087,034 | 4/1963 | Beers et al. | 200/144 B |
| 3,555,223 | 1/1971 | Robinson et al. | 200/144 B |
| 4,081,640 | 3/1978 | Rich | 200/144 B |
| 4,088,860 | 5/1978 | Abe et al. | 200/144 B |

FOREIGN PATENT DOCUMENTS 1027786 4/1966 United Kingdom .

*Primary Examiner*—James R. Scott

*Attorney, Agent, or Firm*—Diller, Ramik & Wight

[57] ABSTRACT

A high tension vacuum switch, comprising two relatively axially movable switching contacts and two annular electrodes for shielding the open contacts from excessive electric field, in which each shield is associated and electrically coupled with a respective one of said switching contacts and projects slightly beyond the contact surface of said contact in the direction towards the other switching contact to provide the field-shielding effect when the contacts are open. At least one of the shielding electrodes is not directly connected electrically but is only capacitively coupled with its respective switching contact so as to add the advantage of much smaller overall dimensions for a switch of this kind.

9 Claims, 2 Drawing Figures

HIGH TENSION VACUUM SWITCHES

BACKGROUND OF THE INVENTION

The invention relates to a high tension vacuum switch comprising two relatively axially movable switching contacts, associated with each one of which is an annular shielding electrode which is electrically coupled with its respective switching contact and protrudes, in the opened condition of the switch and in the direction of the closing movement, slightly from the contact surface of the switching contact.

In a like vacuum switch, e.g. the switch disclosed in the U.S. Pat. No. 3,914,568, the said shielding electrode serves the purpose to create, in the opened condition of the switch in front of the contact surface of the respective switching contact, an electric field which decreases the risk of an arc discharge between the contact surfaces of both switching contacts preceding the closing of the switch. Originally these contact surfaces are smooth and they have a high voltage strength, but during operation they will become rougher owing to the arc discharge which directly precedes the closing of the switch, whereby the voltage strength decreases. The increasing roughness of the contact surfaces is not only the result of burning by the arc discharge but also of the fact that during the closing of the switch the contacts are welded one to the other and during the opening of the switch are again pulled loose from one another. By using the shielding electrode it is achieved that, after starting the closing operation of the switch, the respective switching contacts still remain some time outside the electric field coming from the other switching contact and being sufficiently strong to introduce an arc discharge, so that the switch keeps a sufficiently high voltage strength irrespective of the fact that the contact surfaces become rougher.

In order to prevent the occurrence of an arc discharge between the shielding electrodes themselves or to avoid that, during an arc discharge from a switching contact, the respective shielding electrode is hit by metal particles torn from said contact, whereby the smoothness of its surface may be affected and the risk of an arc discharge between the two shielding electrodes themselves increases it is necessary in the known vacuum switch to mount the shielding electrodes relatively far from the contact surfaces of the switching contacts.

This has the disadvantageous result that the outer dimensions of the vacuum switch become larger, the switching stroke to be effected by the driving mechanism of the switch becomes longer and the masses to be moved become greater.

BRIEF SUMMARY OF THE INVENTION

The invention has the object to avoid these disadvantages and to provide a high tension vacuum switch of the described type, in which the effect aimed at by the provision of a shielding electrode is entirely realized without the necessity of an undesired enlargement of the dimensions of the switch and the driving mechanism belonging thereto.

To this end it is suggested, according to the invention, to couple in a high tension vacuum switch of the type mentioned here-above at least one of the shielding electrodes capacitively with its respective switching contact. In accordance with the invention such a coupling can be realized in a simple way, when, seen in radial direction, a layer of insulating material is provided between the contact rod carrying the switching contact and the respective shielding electrode. Such an insulating layer creates only a slight potential difference between the switching contact and the respective shielding electrode, so that the diëlectric load of the insulating layer is small. As a result of the fact that such a capacitor has a relatively small value, the current of the arc discharge through the shielding electrode will be so small as to avoid burning of the shielding electrode. Due thereto the surface of the shielding electrode will remain relatively smooth, so that the voltage strength of the switch constructed in accordance with the invention remains great.

According to the invention it may be advantageous to give the layer of insulating material the shape of a sleeve which serves the purpose of carrying at least a portion of the shielding electrode. In that case the invention provides a very simple construction, when the capacitor which is necessary for the electric coupling between a switching contact and the respective shielding electrode has the shape of a cylinder condenser consisting of at least a portion of the shielding electrode which forms the outer plate, the sleeve of insulating material which lies against the inner side thereof and forms the diëlectric and a metal cylinder which lies against the inner side of the sleeve, is galvanically connected with the respective switching contact and forms the inner plate. Such a structure permits the formation of the shielding electrode as a woven body which is made from wires or metalized filaments. As this body has a great number of apertures, most metal particles which during an arc discharge are torn loose from the respective switching contact will escape through said apertures, whereas only a very small number of these particles will hit the shielding electrode. The latter metal particles will, however, not seriously affect the voltage strength of the shielding electrode, as these particles will become deformed around the material of the filaments of the shielding electrode, whereby a firm connection with this material is produced and the relatively smooth surface of the shielding electrode is preserved. An other advantage of this measure is that a shielding electrode formed in this way can be at a relatively small distance from its respective switching contact. Consequently, the use of such a shielding electrode need not lead to an increase of the dimensions of the vacuum switch. Besides, the just mentioned construction of a shielding electrode offers, according to the invention, the possibility of giving the two shielding electrodes such different diameters as to ensure that one fits concentrically within the other one. In that case a very simple construction is obtained when one switching contact is formed, within the high tension vacuum switch, as a fixed contact and provided with an also stationary shielding electrode and the other switching contact is formed as a movable contact and provided with a shielding electrode mounted for movement along therewith. Then the driving mechanism of the switch has only to drive the latter movable contact, so that the mechanism can be of relatively simple construction.

BRIEF DESCRIPTION OF THE DRAWING FIGURES

The invention will now be elucidated with the aid of the accompanying drawing of some embodiments. However, the invention is not restricted thereto. In the drawing:

FIG. 1 shows diagrammatically an axial sectional view of a first embodiment of a high tension vacuum switch, and FIG. 2 shows a similar sectional view of a second embodiment of the invention.

DETAILED DESCRIPTION OF THE INVENTION

Figure 1:
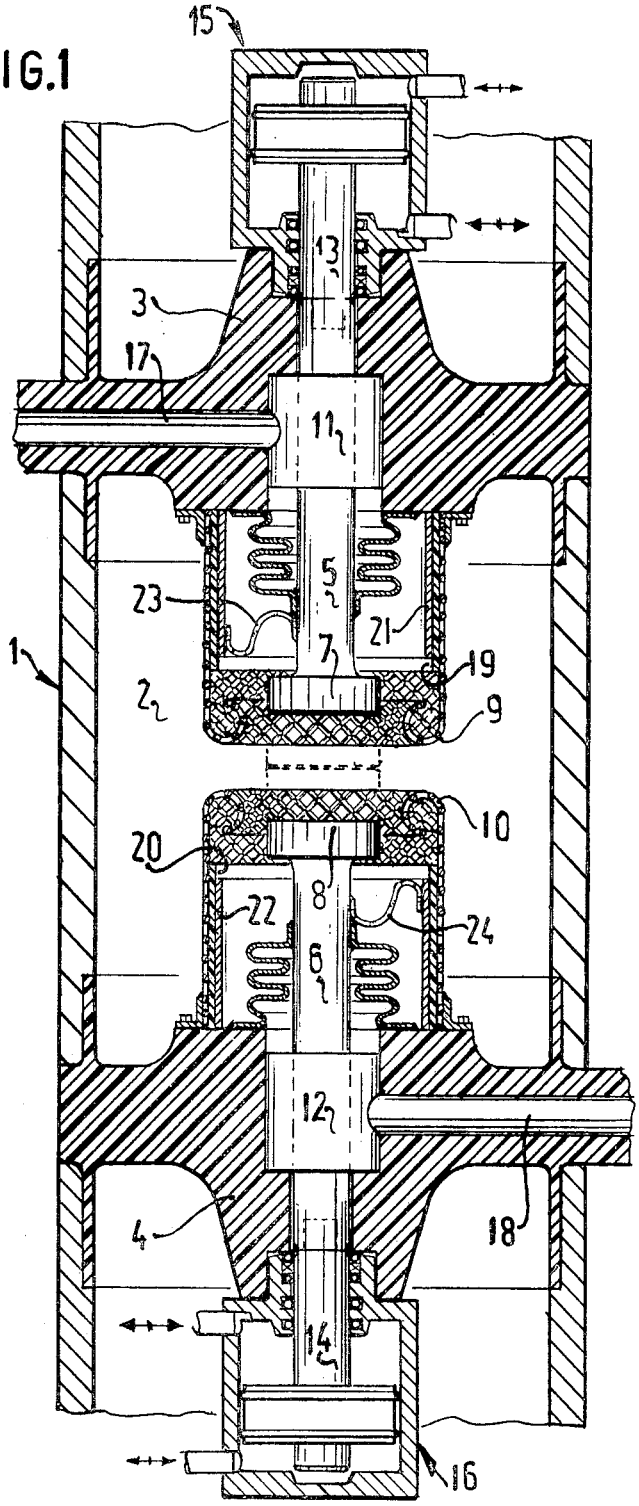

FIG. 1 shows of the casing of the illustrated high tension vacuum switch only the cylindrical metal part 1, within which a switching chamber 2 evacuated in a way not shown in the drawing is separated by two bodies 3 and 4 of insulating material, which also serve the purpose of supporting and guiding contact rods 5 and 6 which extend both in the longitudinal axis of part 1 and carry at their ends facing each other respectively the switching contacts 7 and 8, with which the shielding electrodes 9 and 10 constructed in accordance with the invention are associated. The latter will be described in greater detail.

The above-mentioned parts 1–8 of the high tension vacuum switch shown in FIG. 1 do, neither as to their construction nor as to their operation, not form part of the invention and they can be of any appropriate type, so that a succinct description of these parts and their operation suffices.

The already mentioned contact rods 5 and 6, which are mounted for sliding in the bodies 3 and 4 by means of sleeves 11, 12 of well conductive material, such as metal, are, at their ends remote from one another, insulatedly coupled in a way not shown in the drawing respectively with the piston rods 13, 14 of piston-cylinder-systems 15, 16 used for driving said rods 5, 6. The construction and the operation of the two systems 15 and 16, which during operation can be driven synchronously by means of a fluid under pressure for controlling the switch will not be described in detail. As to the electric connection of the switching contacts 7 and 8 reference is only made to the lead-in conductors 17 and 18 protruding from the sleeves 11 and 12.

The same as to parts 1–8 applies to parts 11–18. All appropriate constructions and operations thereof are possible.

As already has been observed, associated with the switching contacts 7 and 8 are shielding electrodes 9 and 10 which must have for the result aimed at (protection against excessive phenomena of arc discharge between the switching contacts 7 and 8) in any case at least substantially the same potential as their respective switching contacts 7, 8, when the switch is in its open condition.

As is stipulated by the invention and moreover is clearly indicated in FIG. 1, the above-mentioned potential requirement is met by the capacitive coupling between the switching contact on one hand and the shielding electrode associated therewith on the other hand. Thus the upper part of the shielding electrode 9 shown in FIG. 1 may be considered as the outer plate of a cylinder condenser, of which the diëlectric is formed by a sleeve 19 of insulating material lying against the inner side of the said electrode part and the inner plate is formed by a metal cylinder 21 lying against the inner side of the sleeve 19 and being connected galvanically with the contact rod 5, consequently also with the switching contact 7 through a resilient contact 23. In a similar manner a cylinder condenser is recognized in the lower half of FIG. 1, said condenser consisting of the lower part of the shielding electrode 10 forming the outer plate, a sleeve 20 of insulating material lying against the inner side thereof and forming the diëlectric and a metal cylinder 22 lying against the inner side of this sleeve and forming the inner plate, the latter being connected galvanically with the contact rod 6 and the switching contact 8 through a resilient contact 24.

The condensors consisting of the just mentioned elements 9, 19 and 21 and 10, 20 and 22 have a relatively small capacitive value, so that the current of an arc discharge, if any, which would flow through the shielding electrodes 9 and 10 would also have such a small value that burning of the shielding electrodes would not happen.

As has been observed, surface roughening of the shielding electrodes 9 and 10 must be avoided, which roughening is due to arc discharge occurring between their respective switching contacts 7 and 8. Thus, in the conventional construction of a high tension vacuum switch such as is disclosed in the aforesaid U.S. Pat. No. 3,914,568, it is necessary to space the adjacent ends of the shielding electrodes relatively far from each other so that the contacting surfaces of the switching contact 7 and 8 are spaced well beyond the ends of the electrodes when the contacts are close enough to cause arcing therebetween.

The above described cylinder-condenser structure of the shielding electrodes 9 and 10, in which the latter are supported over a substantial portion of their axial dimension by the parts 19, 21 and 20, 22, respectively, makes it also possible to form the outer plate of the cylinder condenser, that means the shielding electrode itself as a woven body made from wires or metalized filaments and, consequently, having between the wires or filaments a great number of apertures. This has the result that the metal particles flying from an arc discharge between the switching contacts 7 and 8 mostly escape through these apertures, whereas the much smaller number of metal particles hitting the wires or filaments will affect the profile of the shielding electrode only slightly as said particles become deformed about the wires or filaments.

The effect of the measures described here-above, that means of the capacitive coupling of a shielding electrode with its respective switching contact and furthermore of the construction of the shielding electrode as a body woven from wire makes it possible to obtain a structure of relatively small axial dimensions notwithstanding the use of shielding electrodes associated with the switching contacts.

Figure 2:
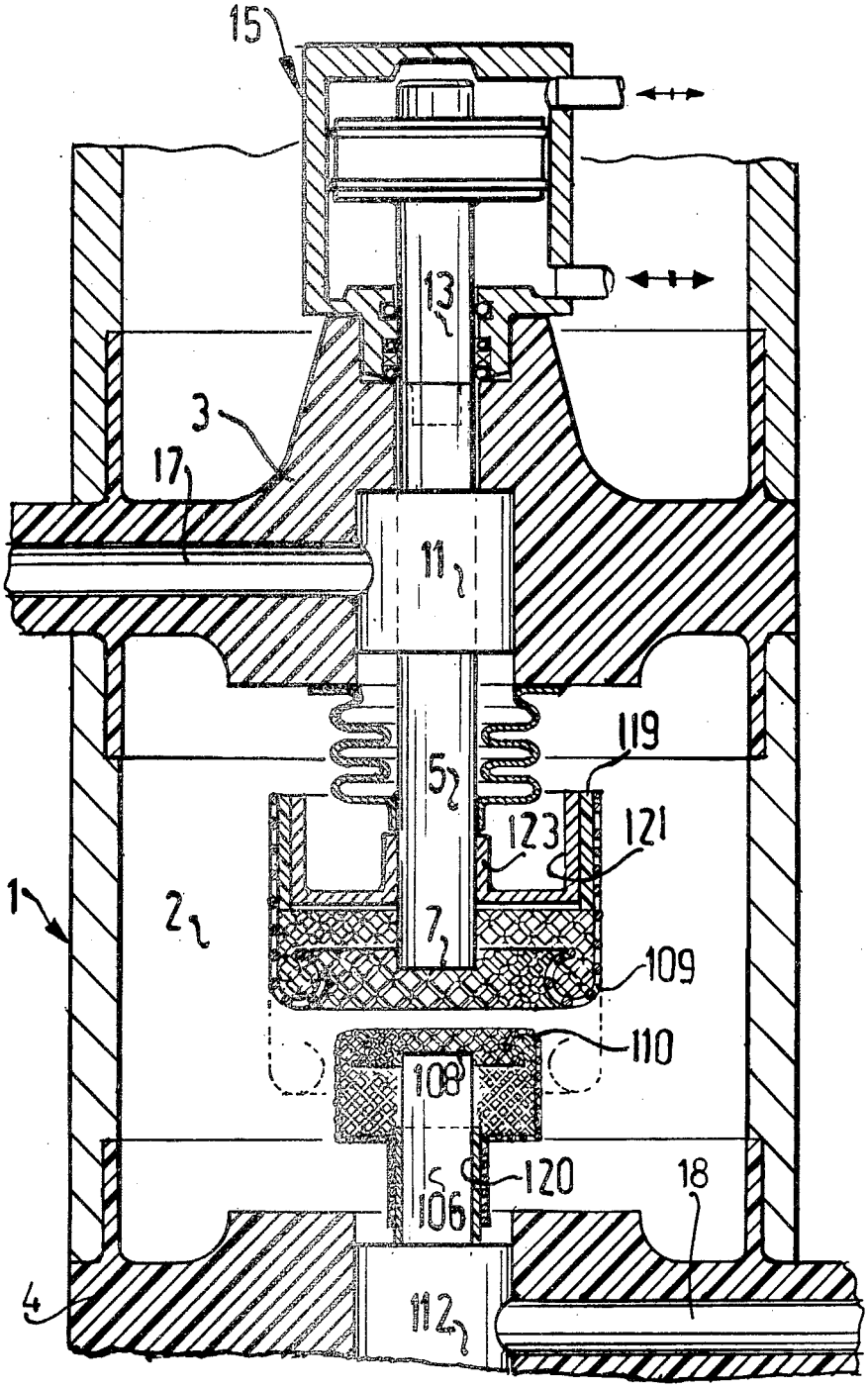

FIG. 2 shows in a manner similar to that of FIG. 1 a second embodiment of a high tension vacuum switch constructed in accordance with the invention. Therein the fact is used that the two shielding electrodes 109 and 110 can be formed as a body woven from wires or metalized filaments and have, as in the embodiment illustrated in FIG. 1, apertures between the wire or filament portions. However, in this case the two shielding electrodes have diameters which differ in such a manner as to enable the insertion of the lower shielding electrode 110 concentrically into the upper shielding electrode 109. The construction is such that the lower switching contact 108 is a fixed contact which is provided with a stationary shielding electrode 110, whereas the upper switching contact 7 is formed as a movable contact and in this case provided with a shielding electrode 109 mounted for moving along therewith.

In this case the capacitive coupling between the upper shielding electrode 109 and the upper switching contact 7 is achieved by means of a cylinder condenser, of which the outer plate is formed by the upper portion of the shielding electrode 109, the diëlectric by a sleeve 119 of insulating material and the inner plate by a metal cylinder 121, which is connected with the upper contact rod 5 by means of an inner flange 123. The lower switching contact 108 is provided at the upper end of a stationary contact rod 106 which at its lower end is connected to or forms part of an also stationary metal body 112 which is incorporated in the supporting body 4 of insulating material in a similar way as the sleeve 12 of the embodiment shown in FIG. 1. The lower shielding electrode 110 which, as already has been observed, fits coaxially within the upper shielding electrode 109, when the switch is in the closed condition shown in broken lines in FIG. 2, is capacitively coupled with the stationary contact rod 106 through a sleeve 120 of insulating material. Obviously, in this case there are no piston rod and piston-cylinder-system for driving purposes, such as the piston rod 14 and the piston-cylinder-system of the embodiment shown in FIG. 1, associated with the lower switching contact 108 and the respective contact rod 106. Since the other parts of the embodiment shown in FIG. 2 principally entirely correspond with those of the embodiment illustrated in FIG. 1 they are indicated by the same reference numerals.

FIG. 2 illustrates clearly that in the embodiment in question not only a structure of smaller axial dimensions than in the embodiment shown in FIG. 1 is obtained but that also the entire driving mechanism for the lower switching contact is absent, so that the axial dimensions of the high tension vacuum switch are still further reduced and moreover the driving mechanism is substantially simplified. This is especially the result of the fact that during an arc discharge between the switching contacts 107 and 108 the flying metal particles mostly escape through the apertures of both the shielding electrode 110 and the shielding electrode 109, so as to leave the relatively smooth profiles of these shielding electrodes as much as possible unaffected.

What we claim is:

1. In a high tension vacuum switch of the type having first and second switching contacts, means for axially moving at least one of said contacts back and forth between an open condition in which the two contacts are spaced apart and a closed condition in which the contacts are engaged, and shielding electrode means surrounding and enclosing said contacts when the switch is in said open condition for allowing said contacts to withstand high voltages, without arcing, despite contact-roughness thereof due to prior arcing incidental to switching, the improvement wherein said shielding means comprises first and second outer hollow conductors respectively surrounding said first and second contacts, said hollow conductors having adjacent end portions which are disposed in axially spaced relation when the contacts are in open condition and which end portions extend beyond their respective contacts when the contacts are in such open condition whereby to locate such contacts in regions of relatively low-intensity electric field when in open condition, means mounting at least one of said hollow conductors in electrically insulated relation to its respective contact, and capacitance means connected electrically to said respective contact for capacitively coupling said one hollow conductor to its respective contact.

2. In a high tension switch as defined in claim 1 wherein both hollow conductors are mounted in electrically insulated relation to their respective contacts and said capacitance means comprises first and second inner hollow conductors surrounding and electrically connected to said respective first and second contacts and spaced inwardly from the respective first and second outer hollow conductors, and dielectric sleeve means filling the spaces between said outer hollow conductors and said inner hollow conductors.

3. In a high tension switch as defined in claim 2 wherein said outer and inner conductors are all of cylindrical form.

4. In a high tension switch as defined in claim 2 or 3 wherein said outer hollow conductors are of open mesh construction.

5. In a high tension switch as defined in claim 2 wherein both contacts are moved by said means for axially moving, each of said first and second outer hollow conductors being fixed, and said inner conductors being slidable within said dielectric sleeve means.

6. In a high tension switch as defined in claim 2 wherein said one contact is moved by said means for axially moving and the other contact is fixed; said inner conductors, dielectric sleeve means and said outer conductors being carried by their respective contacts, and one of said outer hollow conductors being of larger diameter than the other to allow said end portion thereof to be penetrated by the end portion of said other, without engagement, when said contacts are closed.

7. In a high tension switch as defined in claim 5 or 6 wherein said outer and inner conductors are all of cylindrical form.

8. In a high tension switch as defined in claim 7 wherein said outer hollow conductors are of open mesh construction.

9. In a high tension switch as defined in claim 1 wherein said capacitance means comprises an inner hollow electrode surrounding and electrically connected to said contact associated with said one outer conductor, said inner conductor being disposed within and spaced from said one outer conductor and a dielectric sleeve filling the space therebetween.

* * * * *